US009560902B2

(12) United States Patent
Hogan et al.

(10) Patent No.: US 9,560,902 B2
(45) Date of Patent: Feb. 7, 2017

(54) RATCHET-TYPE EXPANSION SYSTEM FOR LUGGAGE AND LUGGAGE INCORPORATING SAME

(71) Applicant: Briggs & Riley Travelware, LLC, Hauppauge, NY (US)

(72) Inventors: Donald Hogan, Jersey City, NJ (US); Georgene Rada, Northport, NY (US); Jessica LoVerso, Bay Shore, NY (US); Matthew Dierkes, Mount Sinai, NY (US); Richard Krulik, Northport, NY (US); Tsung-Ming (Min) Kung, Taipei (R.O.C.) (TW)

(73) Assignee: Briggs & Riley Travelware, LLC, Hauppauge, NY (US)

( * ) Notice: Subject to any disclaimer, the term of this patent is extended or adjusted under 35 U.S.C. 154(b) by 193 days.

(21) Appl. No.: 13/694,191

(22) Filed: Nov. 5, 2012

(65) Prior Publication Data

US 2013/0140119 A1 Jun. 6, 2013

Related U.S. Application Data

(60) Provisional application No. 61/628,725, filed on Nov. 4, 2011.

(51) Int. Cl.
*A45C 7/00* (2006.01)

(52) U.S. Cl.
CPC ..... *A45C 7/0022* (2013.01); *A45C 7/0031* (2013.01)

(58) Field of Classification Search
CPC ..... A45C 7/00; A45C 7/02
See application file for complete search history.

(56) References Cited

U.S. PATENT DOCUMENTS 281,268 A * 7/1883 Haskell ..... 190/105
287,473 A * 10/1883 Reetz ..... 190/105
(Continued)

FOREIGN PATENT DOCUMENTS

CN 102578779 A 7/2012
EP 1649772 A2 4/2006
(Continued)

OTHER PUBLICATIONS

International Search Report and Written Opinion dated Feb. 14, 2013 issued in PCT/US2012/063474.
(Continued)

*Primary Examiner* — Tri Mai
(74) *Attorney, Agent, or Firm* — Scully Scott Murphy and Presser

(57) ABSTRACT

The article of luggage includes a luggage main body having a bottom surface and a cavity formed to receive articles for packing; an expansion body having a perimeter defining a cavity; a foldable gusset joining the luggage main body to the expansion body; and an expansion and locking device disposed internally at opposite ends of the article of luggage. The expansion and locking device is configured to allow free movement of the expansion body in a compression direction towards the luggage main body and configured to allow locking movement of the expansion body in an expanding direction away from the luggage main body. One expansion and locking device is preferably attached to two or more walls of the luggage. After finishing packing, the luggage is closed and the user pushes the expanding member towards the base member, ratcheting the pawl past the ratchet teeth to collapse the luggage.

3 Claims, 9 Drawing Sheets

(56) References Cited

U.S. PATENT DOCUMENTS

| | | | | | |
|---|---|---|---|---|---|
| 440,278 | A | * | 11/1890 | Payntar | 190/105 |
| 615,552 | A | * | 12/1898 | Hicks | 190/105 |
| 664,043 | A | * | 12/1900 | Holman et al. | 190/105 |
| 712,762 | A | * | 11/1902 | Bukoutz | 190/105 |
| 764,144 | A | * | 7/1904 | McGowan | 190/105 |
| 1,650,793 | A | * | 11/1927 | Hill | 70/74 |
| 1,705,526 | A | * | 3/1929 | Kennedy | 292/281 |
| 6,390,259 | B1 | | 5/2002 | Lu | |
| 6,408,997 | B1 | * | 6/2002 | Chen | 190/103 |
| 7,479,900 | B2 | * | 1/2009 | Horstemeyer | 340/994 |
| 7,909,371 | B1 | * | 3/2011 | Mihlbauer et al. | 292/80 |
| 8,479,900 | B2 | * | 7/2013 | Scicluna | 190/105 |
| 2002/0185350 | A1 | | 12/2002 | Chang et al. | |
| 2005/0067244 | A1 | | 3/2005 | Smith et al. | |
| 2006/0042897 | A1 | * | 3/2006 | Sanderson | 190/120 |
| 2006/0070837 | A1 | * | 4/2006 | King et al. | 190/105 |
| 2007/0151820 | A1 | | 7/2007 | Lin et al. | |
| 2007/0209894 | A1 | | 9/2007 | Selvi | |
| 2009/0166138 | A1 | * | 7/2009 | Gorga | 190/103 |
| 2011/0048881 | A1 | * | 3/2011 | Wang | 190/103 |
| 2013/0140119 | A1 | | 6/2013 | Hogan et al. | |

FOREIGN PATENT DOCUMENTS

| | | | |
|---|---|---|---|
| JP | 3077807 | | 3/2001 |
| JP | 2008515571 | A | 5/2008 |
| TW | 101201849 | | 2/2012 |
| WO | WO2006039725 | A2 | 4/2006 |
| WO | WO2007079412 | A2 | 7/2007 |
| WO | 2013/028974 | A2 | 2/2013 |

OTHER PUBLICATIONS

European Search Report Dated Jun. 10, 2015 corresponding to EP 12844818.0.

Chinese Office Action dated Apr. 23, 2015 corresponding to CN 201280053342.9.

Extended European Search Report dated Dec. 2, 2015 from related European Application No. 15 02 0067.3.

4th Office Action dated Jul. 15, 2016 issued in Chinese Application No. 201280053342.9.

* cited by examiner

RATCHET-TYPE EXPANSION SYSTEM FOR LUGGAGE AND LUGGAGE INCORPORATING SAME

RELATED APPLICATION

The present invention claims the benefit of U.S. provisional patent application 61/628,725 filed Nov. 4, 2011, the entire content and disclosure of which is incorporated herein by reference.

BACKGROUND OF THE INVENTION

Field of the Invention

The present invention relates to luggage expansion systems which readily accommodate the needs of travelers to selectively increase or decrease the luggage capacity as needed, and as well, facilitates packing the article of luggage in the most compact fashion.

Description of the Related Art

Due to limitations in space when traveling, especially on airlines, travelers are limited to a single checked piece of luggage which must conform to particular size restrictions. Similarly, a traveler is limited to a single carry-on luggage that must conform to even stricter size limitations since the carry-on must fit within overhead storage compartments.

Travelers are also in need of enough volume within the luggage to carry all necessary clothing and other items. Many conventional luggage have expandable sections that can be expanded by unzipping the section. With the expandable section unzipped, the traveler realizes additional storage space within the luggage. Once fully packed, the expandable section can be rezipped to compress the clothing and other articles packed in the luggage.

However, the conventional expandable luggage is often quite difficult to rezip when the luggage is fully packed, because the articles inside the luggage resist being compressed.

SUMMARY OF THE INVENTION

The present invention is directed to improvements in luggage expansion systems of the type shown and described in commonly assigned U.S. Pat. Nos. 6,575,272 and 7,426,985, the disclosures of which are incorporated herein and made a part of this application. Present day expandable luggage provides two alternative configurations, one in the collapsed condition, and the other in the extended condition. The present invention provides a ratchet-type expansion system for luggage, wherein upon completion of packing by the user, the user can compress the upper end portion of the luggage and lock it in place to take up any unused space therewithin, resulting in a fully and tightly packed article of luggage which is uniquely compact.

The ratchet device which forms part of the present invention allows free movement in one direction, i.e., the collapsing direction, while permitting movement in the opposite direction, i.e., the expanding direction, by a manual release mechanism which forms part of the device.

The invention relates to a ratchet-type expansion system including a ratchet expansion and locking device for luggage, and luggage incorporating such ratchet expansion device. The device includes a base section having a plurality of ratchet teeth, i.e., preferably nine such teeth, and an opposed pawl section preferably having three such pawls, which are respectively dimensioned and shaped to slide over the ratchet teeth in the luggage collapsing direction, and to prevent movement in the opposite—or expanding—direction, except when a latch is lifted to release the pawls from the ratchet teeth. Any number of ratchet teeth and pawls can be used. Alternative embodiments are also disclosed.

In one alternative embodiment a pivotal lever rocker arm is provided for the pawl section having a single pawl tooth at the free end of the arm.

In another embodiment, each device includes dual spaced apart toothed sections, each such section associated with its own pawl section. The device spans over a relatively larger distance.

In an embodiment of the present invention, the article of luggage includes a luggage main body having a bottom surface and a cavity formed to receive articles for packing; an expansion body having a perimeter defining a cavity; a foldable gusset joining the luggage main body to the expansion body, the foldable gusset allowing the expansion body to move away and towards the luggage main body to vary a size of a volume formed by the cavity of the luggage main body and the cavity of the expansion body; and an expansion and locking device disposed internally at opposite ends of the article of luggage, the expansion and locking device being configured to allow free movement of the expansion body in a compression direction towards the luggage main body and configured to allow locking movement of the expansion body in an expanding direction away from the luggage main body.

The expansion and locking device is a ratcheting assembly having a set of parallel teeth affixed to one of the luggage main body or the expansion body; a pawl configured to engage and disengage from the set of parallel teeth by actuation of a lever, the pawl being affixed to the other of the luggage main body or the expansion body; and a biasing member configured to maintain the pawl in an engaged state with the parallel teeth in the absence of an actuating force applied to the lever.

Additionally, the ratcheting assembly includes a holding assembly having a housing on which the lever is provided, the housing having an elongated opening formed on a surface orthogonal to the lever; and a double column of parallel teeth disposed on a sliding member dimensioned for slideable insertion into the elongated opening, the parallel teeth engaging the pawl inside the housing of the holding assembly.

BRIEF DESCRIPTION OF THE DRAWINGS

The present invention will be described hereinbelow with reference to the drawings, wherein.

FIG. **4*a*-9** illustrate embodiments of a ratchet assembly the luggage in accordance with the present invention;

DETAILED DESCRIPTION OF THE INVENTION

Figure 1:
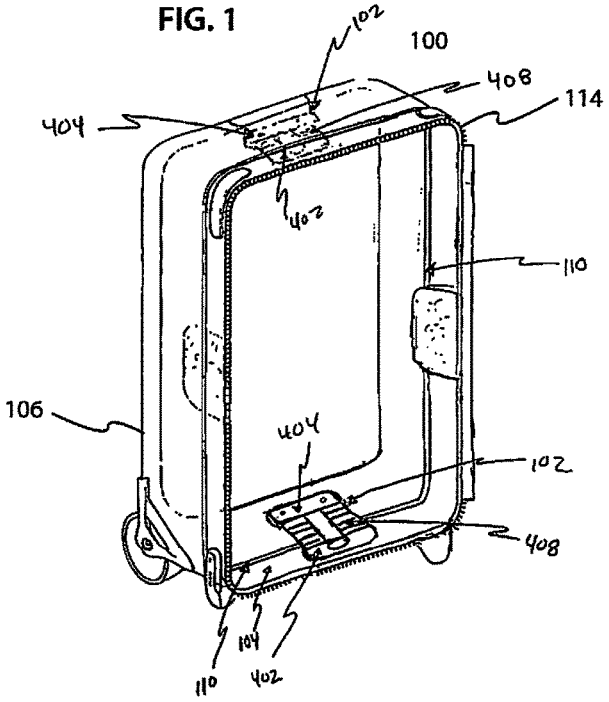
FIG. 1 illustrates a perspective view of an internal area of a luggage in accordance with the present invention.

Referring to the drawings, FIG. 1 provides an internal view of an article of luggage 100, and incorporating an expansion and locking device 102, also referred to herein as a ratcheting assembly, according to the present invention, respectively mounted at opposing inner walls of the luggage 100. The luggage 100 is formed of a luggage main body 106 coupled to an expansion body 104 by a foldable gusset 110, shown in FIG. 2. An openable cover 112 is attached to the expansion body 104 and is sealable by way of engagement of two halves of a zipper 114 provided on at least a majority of the perimeter of the cover 112 and expansion body 104.

Additionally, guide panels 108 are provide on the inside of the luggage 100 at orthogonal sides with respect to the expansion and locking device 102. The guide panels 108 are affixed to one of the luggage main body 106 or the expansion body 104, and slideably contacts the other one of the luggage main body 106 or the expansion body 104. The guide panels 108 provide lateral rigidity to the luggage when in an expanded configuration.

Figure 2:
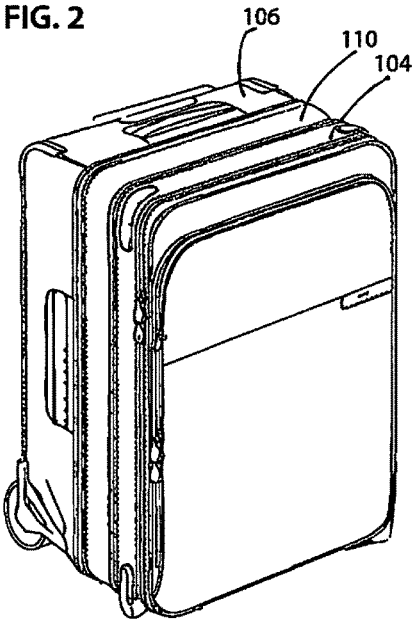
FIG. 2 illustrates a perspective view of an external area of a luggage in an expanded configuration in accordance with the present invention.
Figure 3:
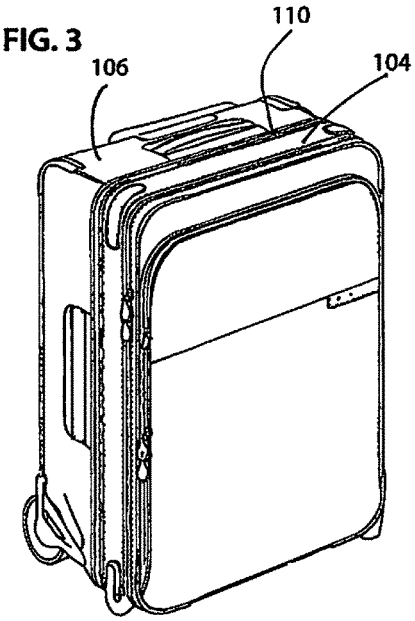
FIG. 3 illustrates a perspective view of an external area of a luggage in a compressed configuration in accordance with the present invention.
Figure 4A:
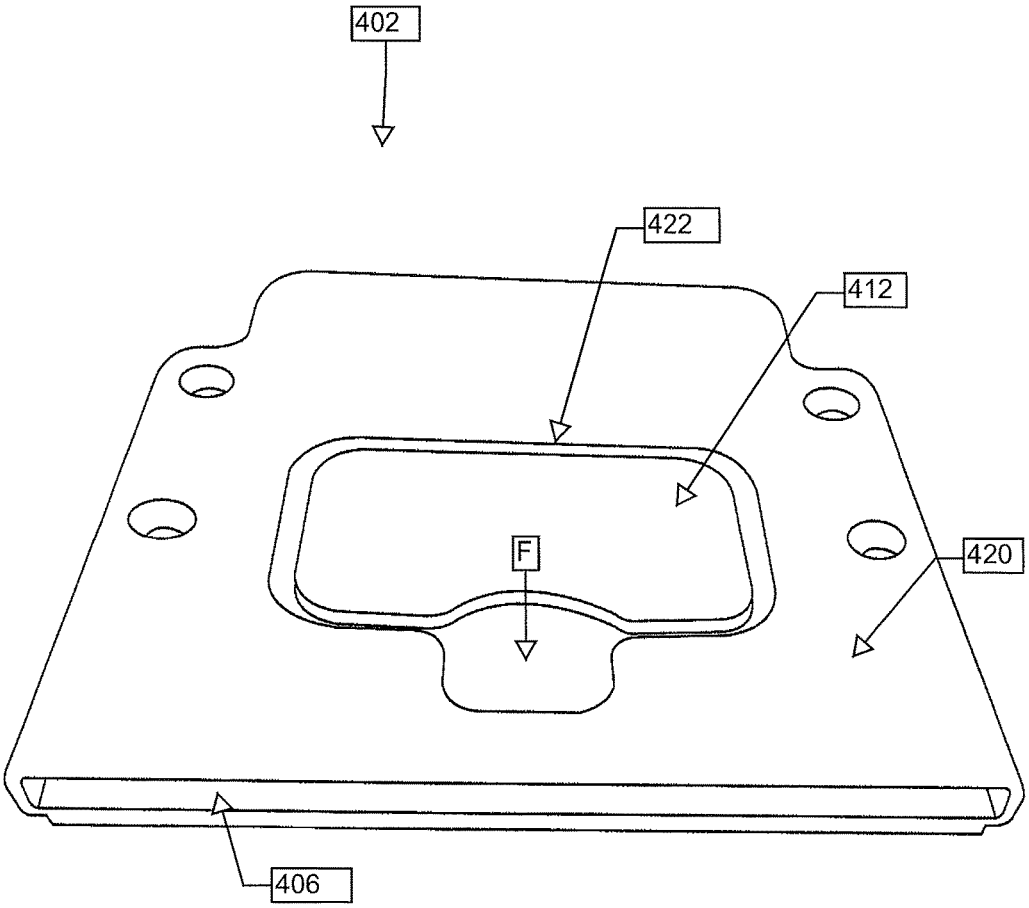
Figure 4B:
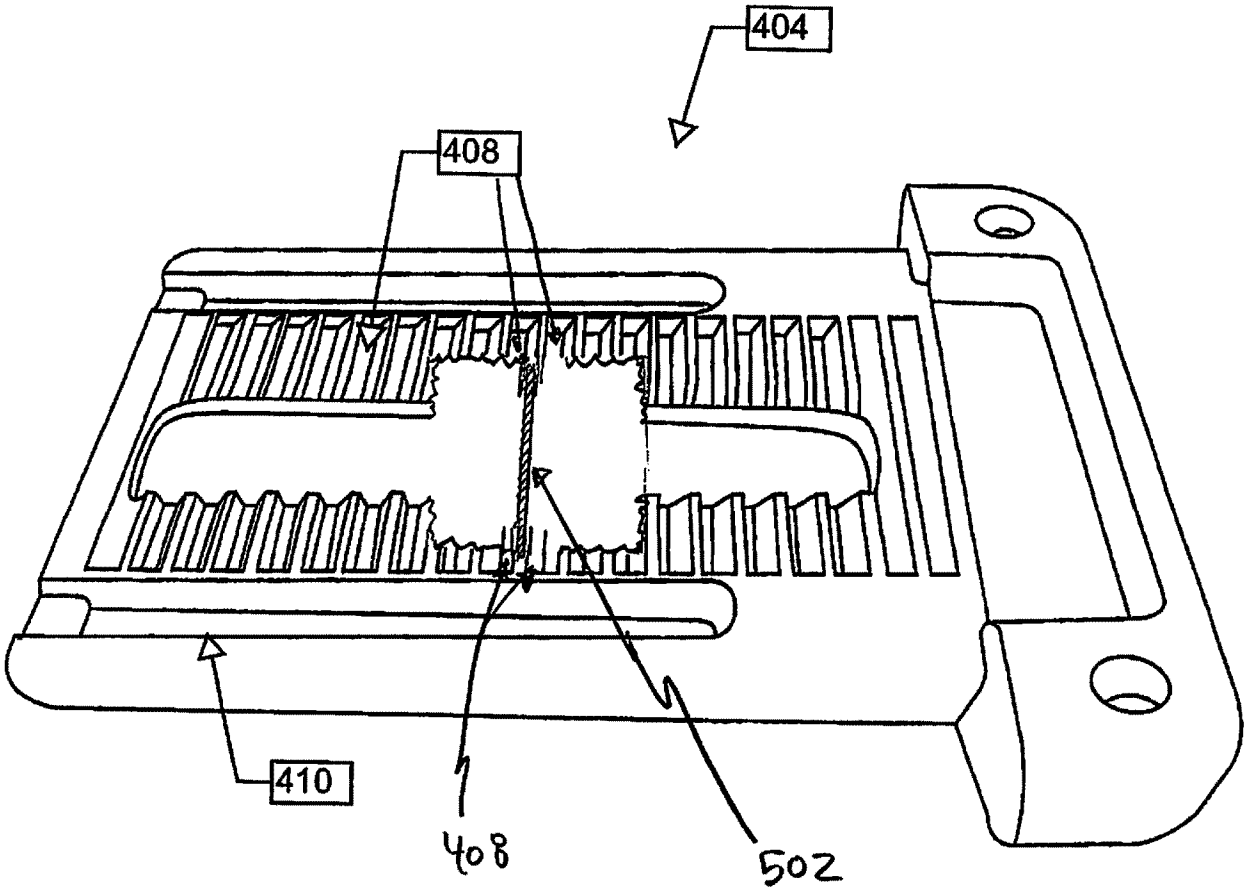
Figure 5A:
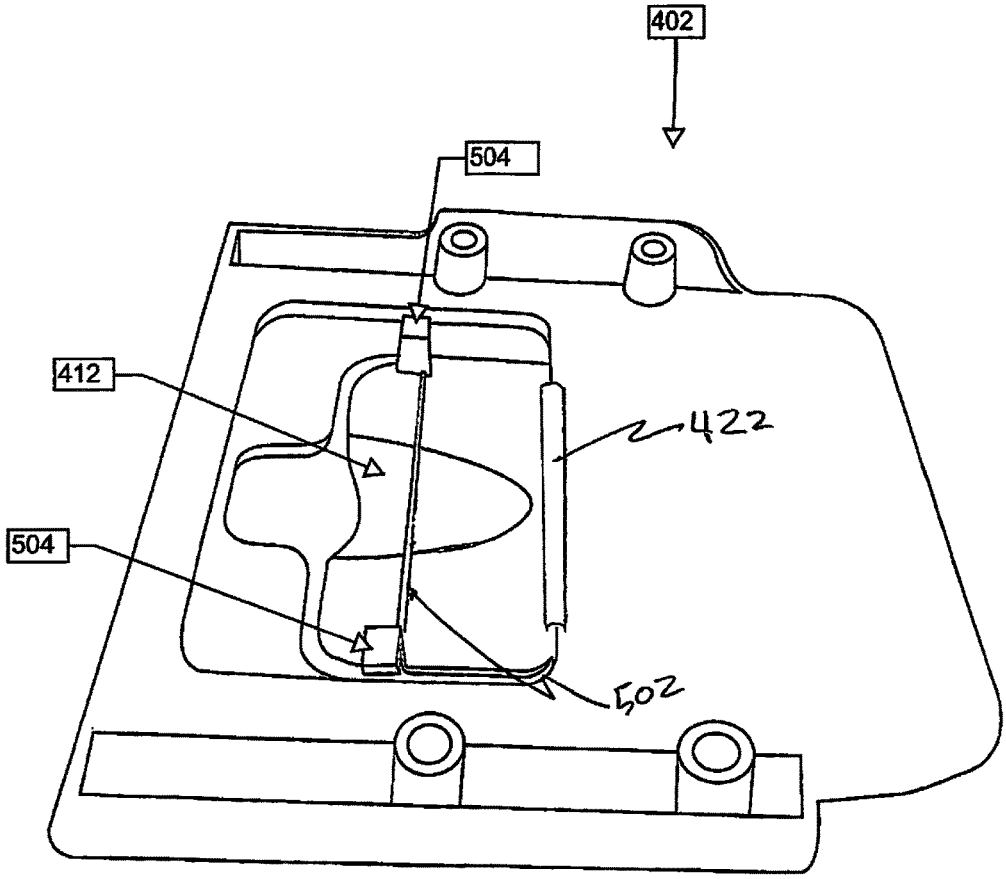
Figure 5B:
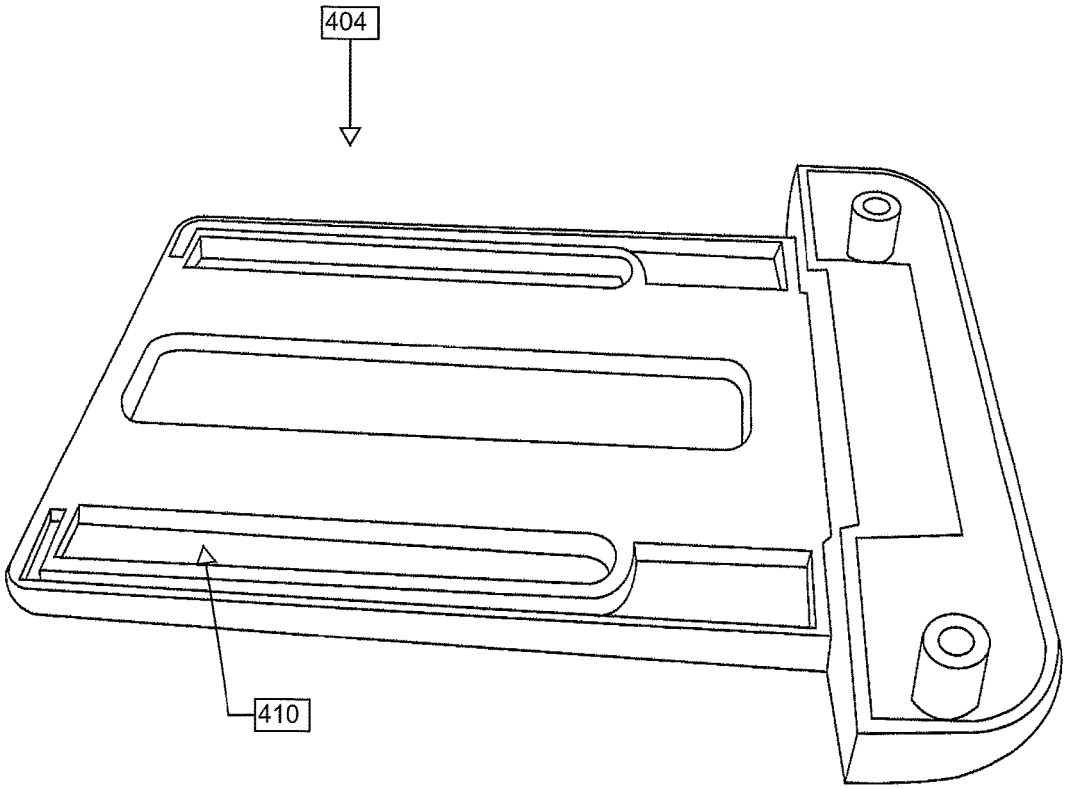

Referring to FIGS. 2 and 3, the luggage 100 is shown in an expanded state as shown by the extended aspect of the foldable gusset 110. FIG. 3 shows the luggage 100 in a compressed state in which the foldable gusset 110 is contracted bringing the luggage main body 106 and the expansion body into closer proximity.

FIGS. 4*a*, 4*b*, 5*a* and 5*b* show an embodiment of the expansion and locking device 102 in detail. The expansion and locking device 102 is formed of a holding assembly 402 (shown in FIGS. 4*a* and 5*a*) and a sliding assembly 404 (shown in FIGS. 4*b* and 5*b*) that is insertable into a receiving opening 406 formed on a surface of the holding assembly main body 420. The sliding assembly 404 includes a set of parallel teeth 408 configured to lockingly interfere with a pawl 502 (shown in FIG. 5*a*) of the holding assembly 402. For example, the parallel teeth 408 are configured to have a surface with a mild angle in the compression direction and a nearly 90° angle formed in the expansion direction.

Additionally, travel limiting slots 410 are provided on the sliding member 406, which limit the extent of travel by the sliding assembly 404 when the travel limiting slots 410 are engage with tabs 504 (shown in FIG. 5*a*) of the holding assembly 402.

It is noted that the pawl 502 and the tabs 504 are disposed on an underside of the holding assembly 402, and more specifically, on the underside of a latch structure 412 of the holding assembly 402. The latch structure 412 is coupled to the holding assembly main body 420 of the holding assembly 402 by a biasing member 422 integrally formed therebetween. The biasing member 422 may be formed of a live spring, coil spring or other deformable structure that provides a rest state in which the latch 412 maintains a holding force between the pawl 502 and the parallel teeth 408. The biasing member 422 allows the latch to maintain engaging force between the pawl 502 and one of the parallel teeth 408 of the sliding member 406. Additionally, when a force normal to the surface of the latch is applied to the latch as indicated by arrow F, the biasing member allows the latch structure 412 to disengage the locking member 502 from the parallel teeth 408.

The sliding member 406 is attached, by means of screws, bolts, or other fixing means, to a portion of the expansion body 104, and the holding assembly 402 is similarly affixed on a portion of the luggage main body 106 in line with the sliding member 406. In an embodiment of the present invention, two expansion and locking device 102 are provided at opposite sides of the luggage 100. However, in an alternative embodiment, one expansion and locking device 102 may be provided at each of the four sides of the luggage 100.

In an alternative embodiment, the sliding member 406 is attached by means of screws bolts or other fixing means to a portion of the luggage main body 106, and the holding assembly 402 is similarly affixed on a portion of the expansion body 104 in line with the sliding member 406.

Figure 6B:
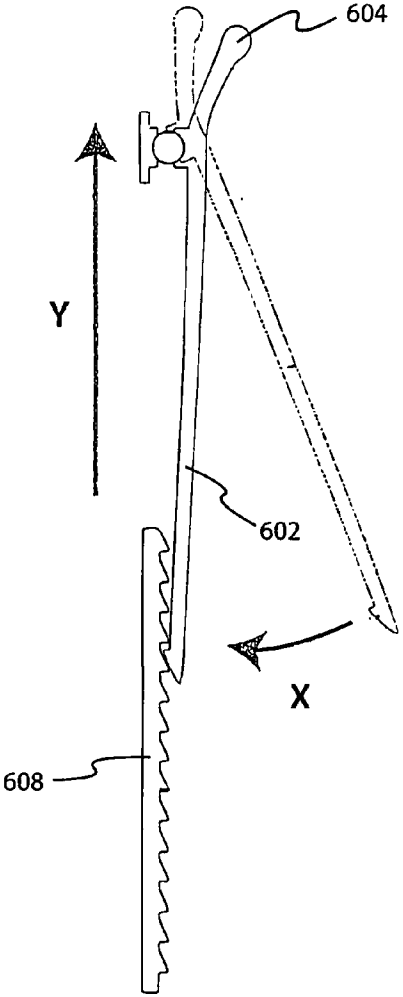
Figure 6A:
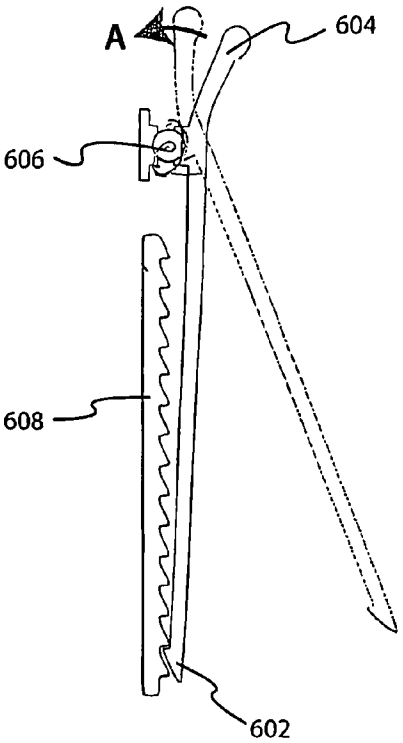

FIGS. 6*a* and 6*b* show a side view of an embodiment of the expansion and locking device 102 of the present invention. In the present embodiment, a lever 604 is provided at a first end, which facilitates engagement and disengagement of a pawl 602 disposed at an opposite end of the holding assembly with a set of parallel teeth 608. A biasing member formed as a coil spring 606 is provided at a pivot point of the holding assembly.

In the present embodiment, the holding assembly is attached to the expansion body 104 and the set of parallel teeth 608 are disposed on the luggage main body 106. When force is applied to the lever 604 in a manner to cause the rotation of the holding assembly in the direction indicated by arrow A, the pawl 602 is disengaged from the set of parallel teeth as indicated by the dashed line representation of the holding assembly. In this configuration, the holding assembly and the expansion body 104 to which it is attached are free to move along the set of parallel teeth 608 as indicated by arrow Y of FIG. 6*b*. when the force applied at the lever 604 is removed, the holding assembly, under the force provided by the coil spring 606, re-engages the pawl 602 with the set of parallel teeth 608 as indicated by the arrow X.

In the engaged configuration, the holding assembly is free to move in the direction opposite to the arrow Y. However, the holding assembly is prevented from moving in the direction indicated by the arrow Y. In this way, the expansion body 104 and the luggage main body 106 can be compressed, but cannot be expanded. The ratcheting system provided by the present invention allows the luggage to be fully expanded by actuating the lever when the luggage is being packed. Once packed and closed, the luggage can be easily compressed by applying even force on the luggage.

Figure 7:
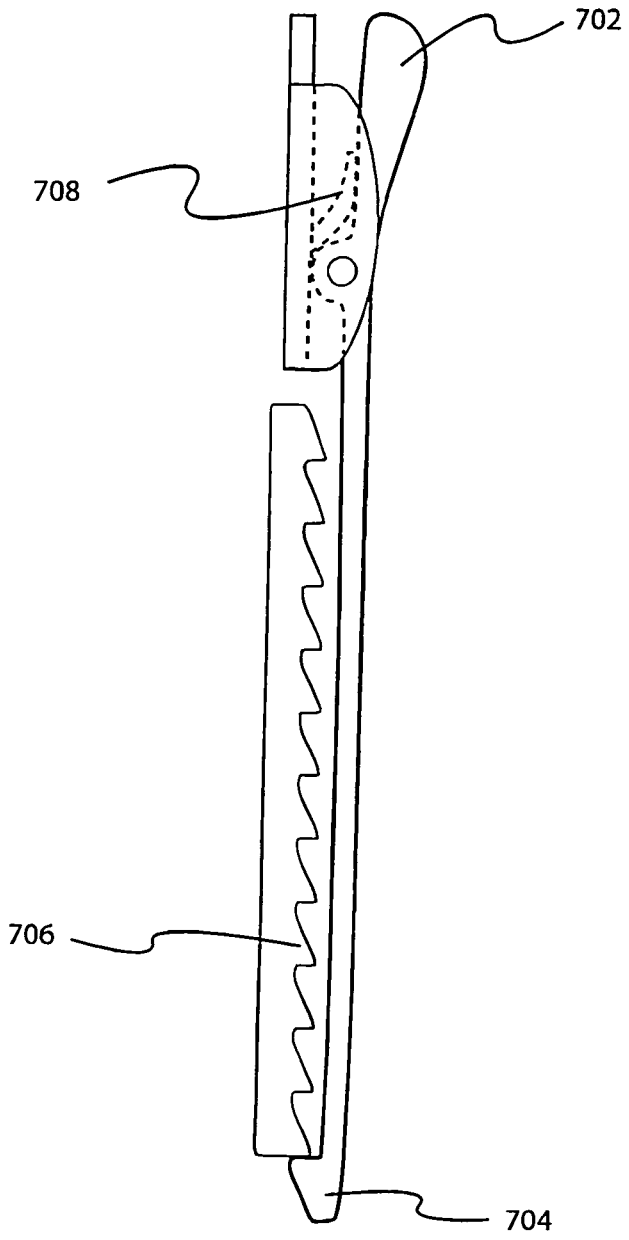

FIG. 7 shows another embodiment of the expansion and locking device 102. Similar to the embodiment shown in FIG. 6*a*, a lever 702 is provided at a first end, which facilitates engagement and disengagement of a pawl 704 disposed at an opposite end of the holding assembly with a set of parallel teeth 706. However, in the present embodiment, the biasing member is formed of a live spring member 708 provided at a pivot point of the holding assembly. The live spring 708 is formed of a material that flexes when sufficient force is applied but returns to its original shape once the deforming force is removed.

Figure 8:
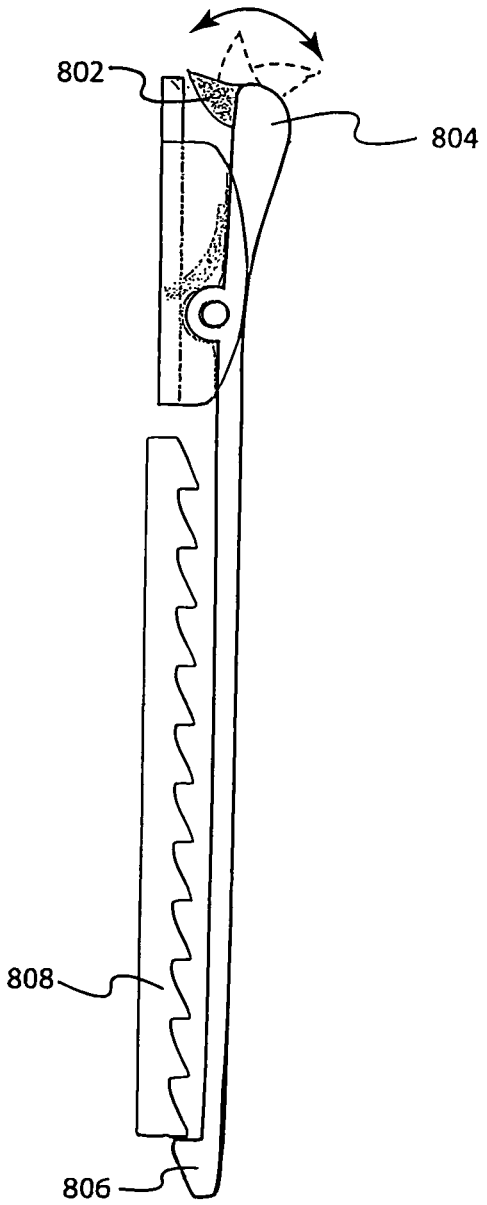

FIG. 8 shows an embodiment that is similar to the embodiment shown in FIG. 7. In the present embodiment, a lever 804 is provided at a first end, which facilitates engagement and disengagement of a pawl 806 disposed at an opposite end of the holding assembly with a set of parallel teeth 808. In addition, the present embodiment is provided with a locking mechanism 802 which is engaged by rotating the locking mechanism as indicated by the arrows. When moved to the locked position, the locking mechanism 802 prevents the lever 804 from disengaging the pawl 806 by way of an accidental application of force to the lever 804. Conversely, when the locking mechanism is rotated to the unlocked position, a force applied to the lever 804 in a manner described above, with respect to FIG. 6*a*, causes the pawl to disengage from the set of parallel teeth 808.

Figure 9:
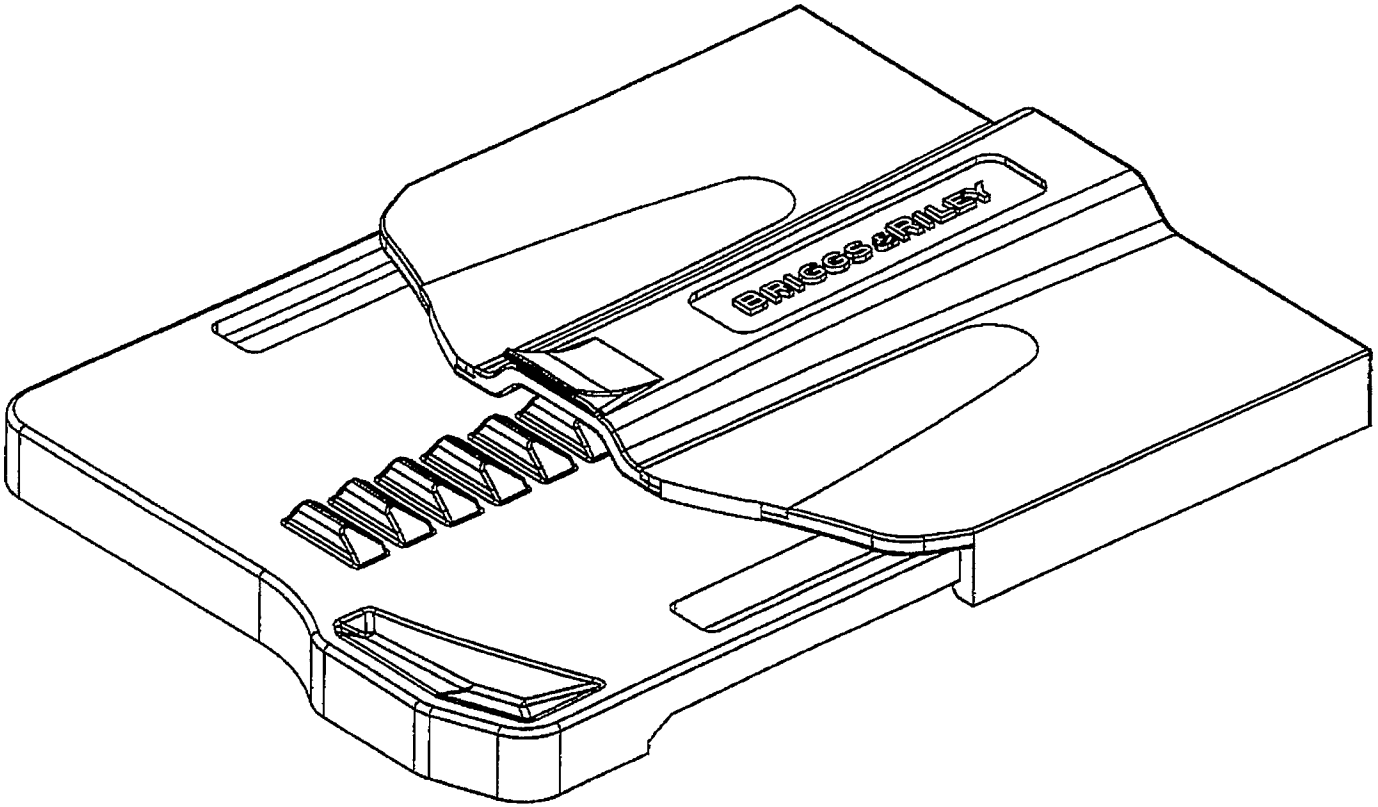

In addition to the biasing members disclosed with respect to FIGS. 4*a* through 8, alternative biasing members can be employed. For example, a rubber member maybe disposed and molded onto a portion of a lever having a pawl disposed there on, and a base surface of the holding assembly. The underlying support structure for the expansion and locking device having rubber molded thereon is shown in FIG. 9. The rubber member is not shown in order to show the supporting structure of the present embodiment. The holding assembly 14 includes a tab 16 integrally formed with one or more pawls on a bottom surface (not shown). The pawl is configured to engage with the plurality of parallel teeth 18 formed on a sliding member 12. The holding assembly is biased to provide engaging force between the pawl and the teeth 18 in a rest state, i.e., when no external force is applied to the tab 16. The indented region 22 of the holding assembly 14 are configured to receive and bond with a rubber compound forming the rubber member.

Additionally, travel limiting slots 20 are provided on the sliding member 12 as described in previous embodiments. Tabs or pins (not shown) disposed on the underside of the holding assembly 14 align with the travel limiting slots 20 and extend into the travel limiting slots 20, thus preventing the sliding member 12 from sliding beyond a predetermined range. Furthermore, the travel limiting slots 20, so configured, prevent the sliding member 12 from disengaging from the holding assembly 14.

The rubber member is of adequate thickness and resilience to require a predetermine amount of force to disengage the pawl disposed on the lever. The elastic nature of rubber allows the lever to return to an engaged rest state when the force is removed. To strengthen the bond between the surfaces of the holding assembly, through holes can be formed on the surface of the holding assembly, which allows the rubber to flow through during the molding process. In one embodiment, the rubber has a Shore A hardness value of between 60 and 65.

Acrylonitrile butadiene styrene (ABS Plastic) can be used to form the lever and pawl of the holding assembly and the set of parallel teeth. Alternatively, the components of the expansion and locking device 102 may be fabricated from metal or a combination of materials.

Although the preferred embodiments show the ratchet member attached to the fixed base of the luggage and the pawl section attached to the movable part, the sections may be structured and arranged to be attached in any order, i.e., the reverse of the order described herein, for example.

What is claimed is:

1. An article of luggage comprising:

a luggage main body having a bottom surface and a cavity formed to receive articles for packing;

an expansion body having a perimeter defining a cavity;

a foldable gusset joining the luggage main body to the expansion body, the foldable gusset allowing the expansion body to move away and towards the luggage main body to vary a size of a volume formed by the cavity of the luggage main body and the cavity of the expansion body;

an openable cover attached to the expansion body; and an expansion and locking device disposed internally at opposite ends of the article of luggage, the expansion and locking device being configured to allow free movement of the expansion body in a compression direction towards the luggage main body and configured to allow locking movement of the expansion body in an expanding direction away from the luggage main body, wherein the expansion and locking device is a ratcheting assembly comprising:

a sliding assembly having a set of parallel teeth, the sliding assembly affixed to one of the luggage main body and the expansion body; and a holding assembly main body affixed to the other of the luggage main body and the expansion body and affixed in line with the sliding member, wherein the holding assembly main body comprises:

a receiving pocket into which the sliding assembly is insertable, wherein the receiving pocket is defined by: a proximal wall affixed to said one of the luggage main body and the expansion body; a distal wall substantially parallel to the proximal wall; and a pair of side walls connecting the proximal wall and the distal wall; and wherein an opening is defined through the distal wall of the receiving pocket, and a latch structure pivotably coupled to the distal wall of the receiving pocket by a biasing member, the latch structure having disposed on its underside a pawl, the latch structure having a planar surface, wherein the latch structure comprises a first configuration in which the latch structure is biased by the biasing member; and when the latch structure is in the first configuration, the latch structure is disposed in the opening of the distal wall the sliding assembly is inserted into the receiving pocket to allow engagement between the pawl and the set of parallel teeth through the opening of the distal wall, and the planar surface of the latch structure is substantially parallel to the distal wall of the receiving pocket; and wherein the latch structure comprises a second configuration in which the latch structure is pivoted by a force that is substantially perpendicular to the planar surface of the latch structure a against the biasing member; and when the latch structure is in the second configuration, the pawl is pivoted away from the set of parallel teeth to release the engagement between the pawl and the set of parallel teeth, and the planar surface of the latch structure is angular with respect to the distal wall of the receiving pocket.

2. The article of luggage as in claim 1, wherein the latch structure further comprises a finger holder for allowing a user to apply the force that is substantially perpendicular to the planar surface of the latch structure.

3. The article of luggage as in claim 1, wherein the sliding assembly comprises an elongated plate and the set of parallel teeth extend from the elongated plate; and wherein the set of parallel teeth each have an undersurface substantially perpendicular to the elongated plate and a slanted surface continuous with the undersurface.

* * * * *